United States Patent [19]

Faubel et al.

[11] 3,992,822

[45] Nov. 23, 1976

[54] INSTALLATION FOR POLISHING PIECES OF CUTLERY

[75] Inventors: Rolf Faubel, Solingen; Gerd Höller, Leichlingen, both of Germany

[73] Assignee: E. Siepmann & Co., Solingen, Germany

[22] Filed: May 13, 1975

[21] Appl. No.: 576,954

[30] Foreign Application Priority Data

May 14, 1974 Germany ..... 2423292

[52] U.S. Cl. ..... 51/237 T; 51/85 R; 51/108 R; 214/1 BC

[51] Int. Cl.[2] ..... B24B 41/06

[58] Field of Search ..... 198/210; 214/1 BC; 51/237 T, 84 R, 85 R, 108 R

[56] References Cited

UNITED STATES PATENTS

| | | | |
|---|---|---|---|
| 2,458,708 | 1/1949 | Johnson | 51/84 R |
| 2,612,005 | 9/1952 | Burt | 51/83 R |
| 3,153,305 | 10/1964 | Burt | 51/85 R |
| 3,718,216 | 2/1973 | Wilson | 214/1 BC |
| 3,745,714 | 7/1973 | Weatherell | 51/85 R |

*Primary Examiner*—Harold D. Whitehead
*Attorney, Agent, or Firm*—Browdy and Neimark

[57] ABSTRACT

The invention relates to an installation for polishing pieces of cutlery or the like, which comprises two rotatable conveyor devices, each adapted to move through a respective circular path for transporting workpiece holders for the pieces of cutlery through work stations disposed on the paths. The holders can now move on the first conveyor device from a clamping device by way of a polishing machine and a re-clamping device back to the clamping device and, on the second conveyor device from the re-clamping device by way of at least one polishing machine and an unclamping device back to the re-clamping device.

8 Claims, 4 Drawing Figures

INSTALLATION FOR POLISHING PIECES OF CUTLERY

FIELD OF THE INVENTION

This invention relates to an installation for polishing pieces of cutlery.

BACKGROUND OF THE INVENTION

The prior art shows installations of this kind in which the conveyor devices provided are conveyor tracks on which balancers are adapted to travel, the individual workpiece holders being transported by these balancers through the first set of polishing machines and to the re-clamping table. At each individual working station the workpiece holder is inserted by hand into the polishing machine or is filled with unpolished pieces of cutlery on the clamping device. In this known installation, although the operators no longer need to transfer the workpiece holders containing the pieces of cutlery from machine to machine, nevertheless, as previously, they must insert them individually by hand into the machines and place them individually by hand on the re-clamping device and clamping or unclamping device. Furthermore, it has been found that the conveyor tracks with their balancers impair the accessibility of the individual machines.

From the periodical "Galvanotechnik" 1958, No. 9, page 755, an automatic installation for polishing pieces of cutlery is known in which the polishing machines are disposed along a continuous rectilinear conveyor track which permits the use of only two workpiece holders, since these must be returned on the same track if transfer by hand is excluded. The two workpiece holders travel between the clamping device and the re-clamping device on the one hand, and between the re-clamping device and the unclamping device on the other hand. The workpiece holders are moved on plates rectilinearly along the main conveyor track in the manner described. These plates together with the workpiece holders are in each case fed at right-angles to the main transport track and horizontally by means of pneumatic driving cylinders to the individual polishing machines. Apart from the low capacity of this installation, the individual polishing machines are practically inaccessible from the front, that is to say from the side from which the workpiece holders are fed, so that the changing of the polishing rollers, which is necessary every day, and the frequent changing-over to different kinds of cutlery, which is often necessary, particularly in smaller plants, are difficult to effect.

From the periodical "Metalloberflache" 1967, No. 2, pages 45 to 48, so-called automatic circular table machines are known for the grinding and polishing of metal workpieces, in which the workpieces are disposed on a table adapted to be driven in timed sequence by equal angular steps and are fed to the individual grinding stations by corresponding timed rotation of the table. Here again the individual grinding devices are inaccessible or accessible only with difficulty from the front, that is to say the side on which the rotatable table is disposed.

SUMMARY OF THE INVENTION

According to the present invention there is provided an installation for polishing pieces of cutlery, comprising two rotatable conveyor devices, each device being adapted to move through a respective circular path for transporting workpiece holders for the pieces of cutlery through work stations disposed on these paths so that the holders move, on the first conveyor device from a clamping device by way of at least one polishing machine and a re-clamping device back to the clamping device and on the second conveyor device from the re-clamping device by way of at least one polishing machine and an unclamping device and back to the re-clamping device.

The conveyor devices comprise rotatable turrets which are each adapted to be driven stepwise about a respective vertical axis of rotation and on which are equi-angularly spaced pivoting arms each consisting of an inner arm part, which by one end is articulated on a rotatable part of the turret about a horizontal axis, and which is adapted to be driven in a pivoting movement radially outwards about said horizontal axis. The conveyor device also includes an outer arm part which is articulated to the other end of the inner arm, and extends radially outwards, with each outer arm part carrying a workpiece holder adjacent to its free end.

A substantial advantage of this invention is that in their retracted position, the pivoting arms carrying the workpiece holders are raised and thus completely free the space between each rotatable turret and the appertaining polishing machines or devices. This enables the polishing rollers to be changed and the polishing machines reset in the simplest manner and without obstructions. Furthermore, the effect is thereby achieved that only as many workpiece holders as there are working stations need be used, since all the workpiece holders are always in use. This provides at the same time a considerable increase of working speed, since apart from the extremely short transport times none of the polishing machines or devices is working without load. The greatest possible height and width of the free space between the rotatable turret and the polishing machine is obtained if in accordance with another advantageous feature of the invention the pivoting arms are adapted to pivot between one position, in which the inner arm part is approximately vertical and the outer arm part approximately horizontal, and another position in which the arm parts are comparatively extended radially. The pivoting movement of the arms is expediently achieved by adapting each pivoting arm for driving by means of a hydraulic or pneumatic cylinder. The cylinders are all adapted to be driven simultaneously in one direction or another by means of a common pressure source, or by arranging for all the pivoting arms of the rotatable turret to be driven by a common hydraulic or pneumatic operating cylinder. In the latter case, the displacement movement of the working cylinder is advantageously transmitted to the various pivoting arms by means of a suitable linkage.

In order to ensure correct insertion of the workpiece holders together with the pieces of cutlery into the individual polishing machines and to permit the greatest possible elongation of the pivoting arms, and in order at the same time to enable the workpiece holders to be guided on the polishing machine by means of a known guide device without the free passage space between the rotatable turret and the polishing machine when the pivoting arm is raised being impaired, it is of great advantage for a minimum angle to be fixed between the outer arm part and the inner arm part by means of a stop; this angle expediently being between 80° and 90°.

Furthermore, it is of great advantage for each workpiece holder to be mounted for sliding, parallel to the horizontal axis, on the outer arm part. With fully automated polishing this permits an oscillating movement of the workpiece holders and consequently of the pieces of cutlery. Moreover, it is of great advantage for each workpiece holder to be mounted pivotally on the outer arm part, since this enables the pieces of cutlery clamped in the workpiece holders to be guided on the polishing rollers in accordance with their shape. Furthermore, it is advantageous for each workpiece holder to have at least one guide roller associated with a cam element on each polishing machine. This ensures that the pivotable workpiece holders can be introduced into and withdrawn from the pairs of polishing rollers in a position in which damage to the pieces of cutlery is impossible. In this case, it is expedient for a restoring device counteracting the pivoting by the cam element and guide roller to act on the workpiece holder, this restoring device pressing the guide roller firmly against the cam element at the beginning of the insertion operation and on extraction and in addition ensuring that after the guide roller has run off the cam element the workpiece holder will always be in the same accurately defined position.

BRIEF DESCRIPTION OF THE DRAWING

An embodiment of the invention will now be described by way of example with reference to the drawings, in which.

DETAILED DESCRIPTION OF A PREFERRED EMBODIMENT

Figure 1:
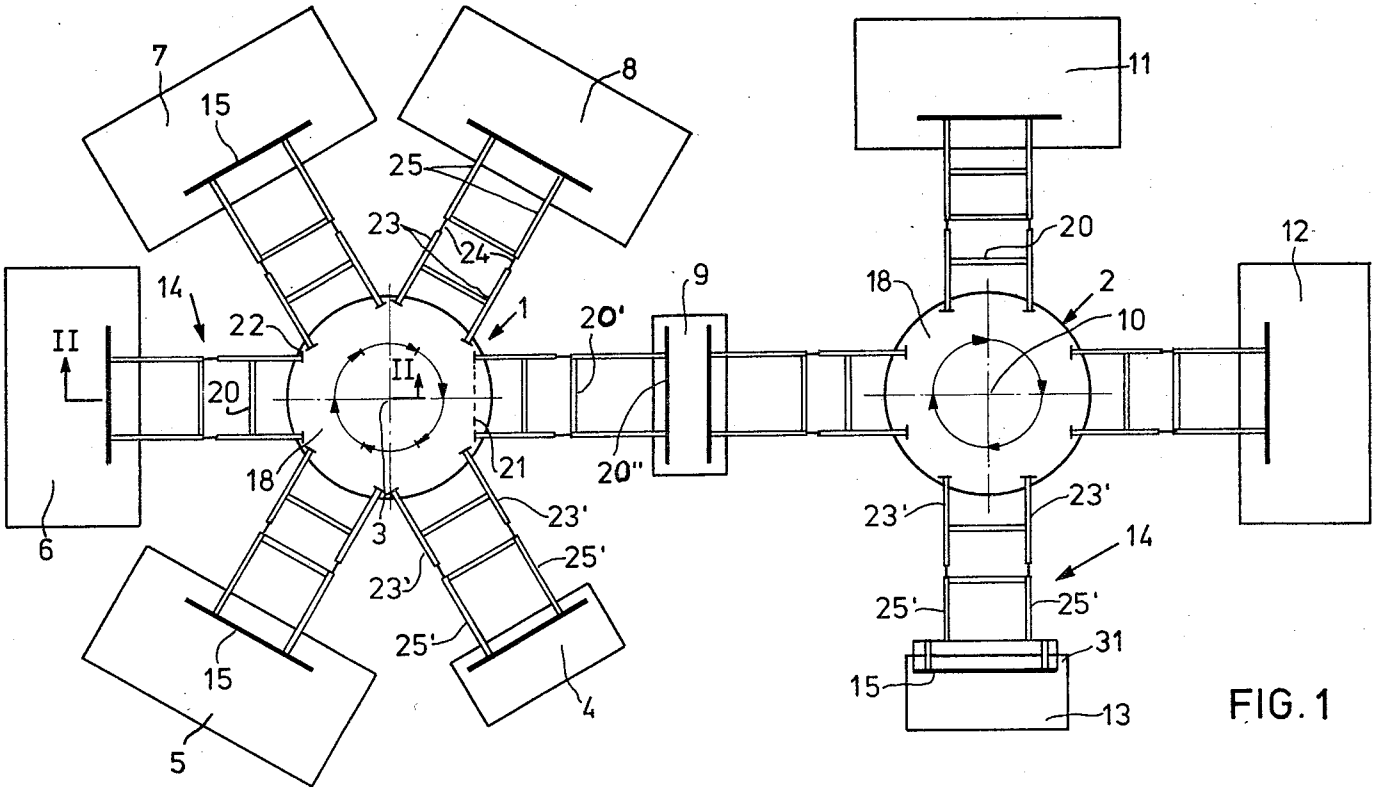
FIG. 1 is a diagrammatically plan view of an installation according to the invention.

In the installation for polishing pieces of cutlery which is shown in FIG. 1, two rotatable turrets 1 and 2 are provided.

A clamping device 4, four polishing machines 5, 6, 7, 8 for prepolishing and finish polishing of, for example, the bowl of a spoon, and a re-clamping device 9 are disposed on a circle about the vertical axis of rotation 3 of the rotatable turret 1, at equal angular distances, that is to say in the present case at angular distances of 60°. The re-clamping device 9, two polishing machines 11, 12 for the prepolishing and finish-polishing of, for example, the handle of a spoon or fork, and an unclamping device 13 are likewise disposed on a circle about the vertical axis of rotation 10 of the second rotatable turret 2, once again at equal angular distances, that is to say in the present case at angular distances of 90°. The vertical plane defined by the axes of rotation 3 and 10 of the turrets 1 and 2 thus coincides with the central transverse plane of the re-clamping device 9.

A number of pivoting arms 14 equal to the number of appertaining polishing machines and devices are articulated on each of the two rotatable turrets 1 and 2, these arms being spaced at the same angular distances as the said polishing machines and devices and each of them carrying at its outer end a workpiece holder 15 for receiving and clamping a large number of pieces of cutlery. Each of the workpiece holders 15 are identical to one another. The construction and functioning of the clamping, reclamping, and unclamping devices and of the polishing machines and their serial arrangement in the work flow is known and widely customary, so that in this respect no further exlanation is required.

Each rotatable turret 1 and 2 has a stationary base 16 on which a rotatable part 17 adapted to turn about the axis of rotation 3 and 10 respectively is mounted. This rotatable part 17 consists of a lower horizontally disposed table 18 and of a column 19 projecting upwards from the table. In the region of the outer edge of the table, the pivoting arms 14, each of which is two-armed, are articulated for pivoting about a horizontal axis 21 by means of joints 22. The pivoting arms 14 consist of an inner arm part 23 which is articulated on the rotatable table by means of the joints 22, and of an outer arm part 25 articulated to the other end of the inner arm part by means of joints 24. Each arm part consists of lever elements 23' and 25' respectively, which lie parallel to one another, the two lever elements 23' of the inner arm part being stiffened by a cross-member 20, while the level elements 25' of the outer arm part 25 have stiffening in the form of a frame means of cross-members 20' and 20'' disposed in the region of their ends.

The inner arm part 23 articulated on the table 18 is in each case adapted to be pivoted, by means of a pneumatic operating cylinder 26 acting approximately at the center of the arm on the cross-member 20, between a substantially vertical position and a position inclined at an angle of about 60° to the vertical.

Figure 2:
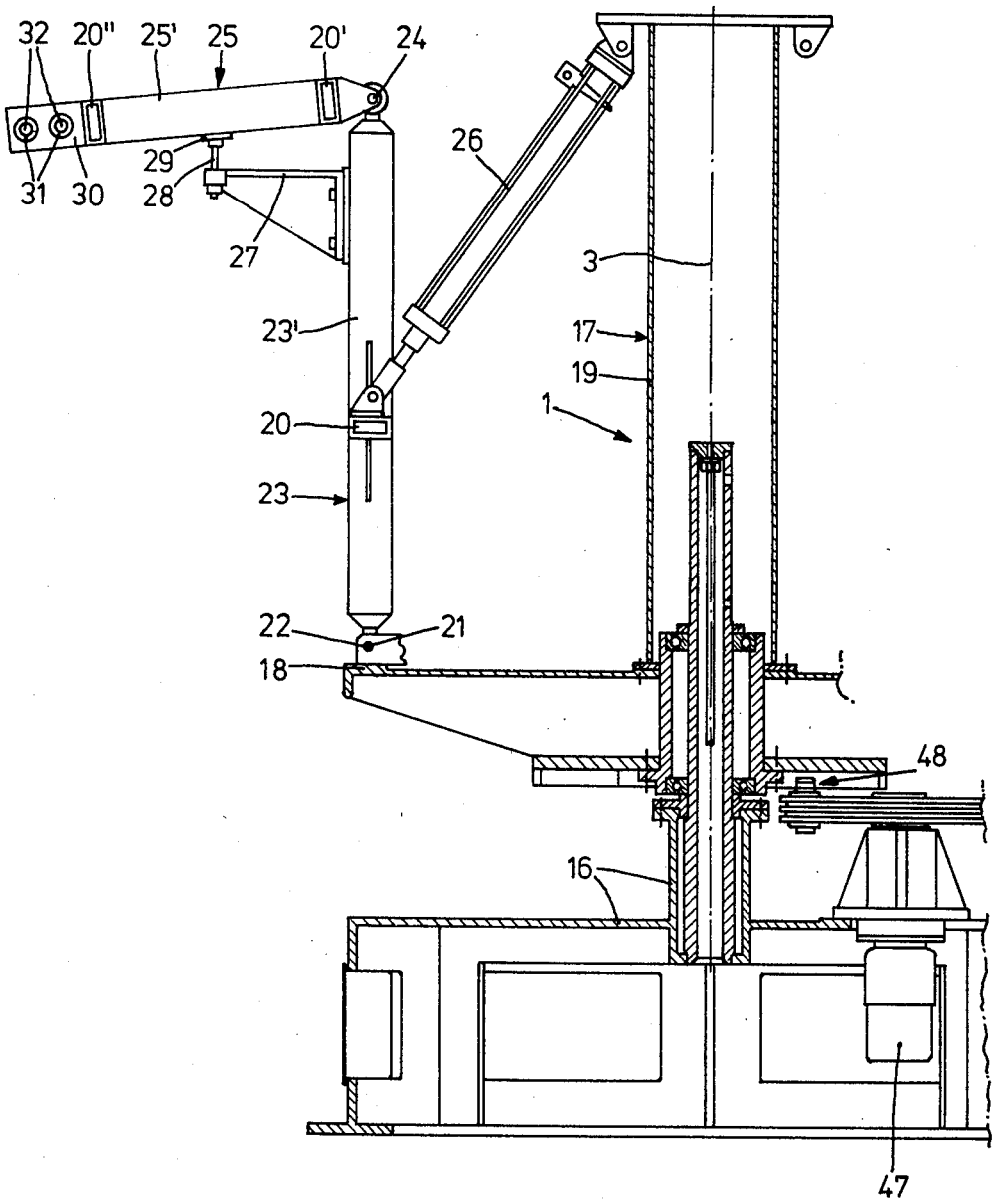
FIG. 2 is a vertical partial section through a rotatable turret of an installation according to FIG. 1, taken on the sectional line II—II in FIG. 1.
Figure 3:
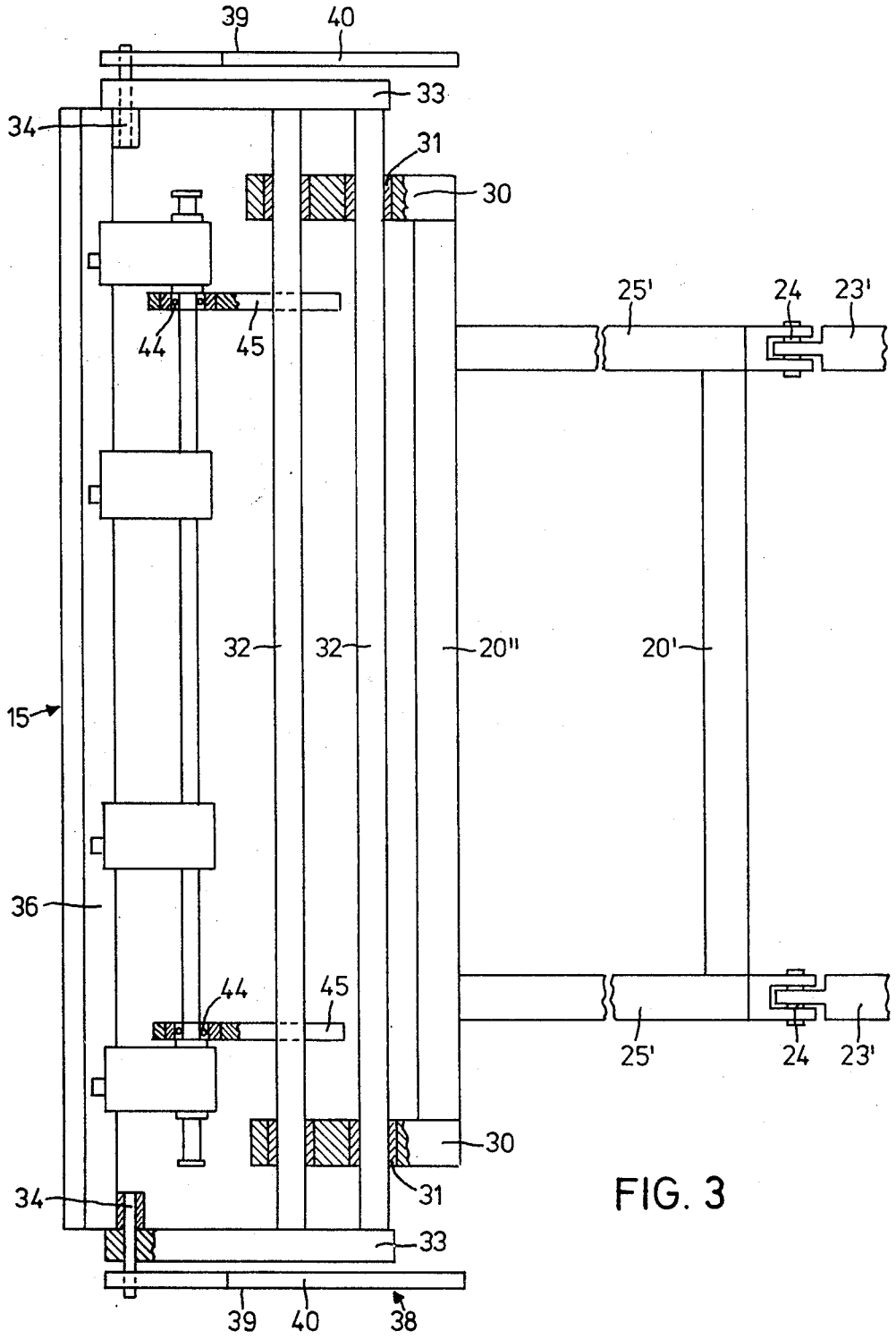
FIG. 3 is a plan view on a larger scale of a pivoting arm with workpiece holder.

A bracket 27 is mounted on the lever elements 23' of the inner arm part 23 in the region of each of the joints 24, which bracket projects substantially at right-angles to the respective lever element 23' and on whose free end is mounted in each case an adjustable stop pin 28 with which is associated a stop surface 29 on the corresponding lever element 25' of the outer arm part 25 in each case. The minimum angle of about 80° to 90° enclosed between the inner arm part 23 and the outer arm part 25 is thereby fixed (see FIG. 2), while the outer arm part 25 can be freely pivoted in relation to the inner arm part 23 in the opposite direction — in the clockwise direction of FIG. 2. Thus, when the inner arm part 23 is swung up through the retraction of the pneumatic operating cylinder 26 the outer arm part is swung up into an approximately horizontal position, while when displacement in the direction of the polishing machine or device takes place, as will be further described below, it can move freely in relation to the inner arm part.

On the cross-members 20'' disposed on the free end of the pivoting arms 14 are mounted holding arms 30 which project parallel to the lever elements 25' and carry guide bushes 31 in which two guide rods 32 are mounted for sliding in the longitudinal direction, parallel to one another, in the plane of the outer arm part 25 and at right-angles to the lever element 25'. Each of the guide rods 32 carries a holding plate 33 at each of its ends, which are therefore slidable transversely in relation to the outer arm part 25 but not pivotable in relation to the latter. By means of a swivel pin 34 in each of the two holding plates 33 a workpiece holder 15, known per se, is mounted for receiving pieces of cutlery 35.

The workpiece holder 15 has two clamp jaws 36, 37 between which these pieces of cutlery 35 are held with elastic clamping. The pivot pins 34 extend through the holding plates 33 and are received in a guide device 38 which is mounted on each polishing machine and which has two guide arms 39, which are optically bent over. The guide device 38 has an upper guide surface 40 facing polishing rollers 41, 42 and in each case is provided with a slot 43 into which the outer end of each pivot pin 34 is introduced.

Behind the pivoting axis (formed by the pivot pins 34 which are in line with one another) of the workpiece holders 15, viewed from the polishing machine, (between this pivoting axis and the outer arm part 25) there are mounted on the workpiece holders guide rollers 44 which on the insertion of the workpiece holders 15 into the slot 43 of the guide device 38 roll over corresponding cam elements connected to the guide device 38 and thus bring the workpiece holder 15, and consequently the clamped pieces of cutlery 35, into a very clearly determined position in relation to the polishing rollers 41, 42, before they are inserted between the latter. The guide rollers 44 are prevented from lifting off the cam element 45 before the insertion of the pieces of cutlery between the polishing rollers 41, 42 or after the pieces of cutlery have been withdrawn from the polishing rollers, by means of a tension spring 46 exerting a rotational moment in the opposite direction.

A guide device 38 for manual insertion of the workpiece holders and manual pivoting of the workpiece holders is well known in the prior art. The guide rollers 44 together with the cam element 45 serve to apply to the workpiece holders 15 a moment counteracting the moment exerted by the polishing rollers, in order to prevent collision between the pieces of cutlery and the polishing rollers on insertion or extraction.

The rotatable part 17 of each rotatable turret 1 or 2 is adapted to be driven relative to the base 16 by means of a drive motor 47 and of an interposed stepping drive 48, for example, a Maltese cross or Geneva mechanism, in angular steps corresponding to the angular spacing of the arrangement in question, that is to say 60° in the left-hand of FIG. 1 and 90° in the right-hand part of FIG. 1.

The installation works in the following manner:

A large number of identical pieces of cutlery 35, for example forks or spoons, are clamped by their handles in the workpiece holder 15 by the clamping device 4. The pivoting arms 14 are in this case all in the radially widely extended position shown in FIG. 1, in which all the operating cylinders 26 are fully extended. After the pieces of cutlery 35 have been clamped between the clamp jaws 36, 37 of the workpiece holders 15 the operating cylinders 26 are retracted, so that the inner arm parts 23, articulated on the table 18, are brought into their approximately vertical position shown in FIG. 2, and the respective outer arm part 25 has been swung up into an approximately horizontal position by the stop pin 28. The rotatable part 17 of the rotatable turret 1 then turns one angular step, that is to say in the present case 60°, so that the pivoting arm presents the still unpolished pieces of cutlery 35 in front of the first polishing machine 5. The operating cylinder 26 is then extended again, so that the inner arm part 23 articulated to the table 18 falls, whereby at the same time the workpiece holder 15 attached to the outer arm part 25 is lowered and moved radially outwards. The outer ends of the pivoting pins 34 are thus brought onto the guide surface 40 of the guide arm 39 and are inserted into the guide slots 43 as far as their ends. When this movement is made on the guide surface 40 the stop surface 29 of the outer arm parts lifts off the associates stop pins 28. During this insertion operation the guide rollers 44 simultaneously roll over the cam elements 45 and bring the workpiece holder 15, and consequently the pieces of cutlery 35 clamped in it, into an accurately defined position relative to the polishing rollers 41, 42, so that damage to the pieces of cutlery during insertion and also subsequently during extraction is avoided. During this polishing operation in the first polishing machine 5 new pieces of cutlery 35 are already clamped on the clamping table 4 in the workpiece holder 15 of the next pivoting arm 14.

Figure 4:
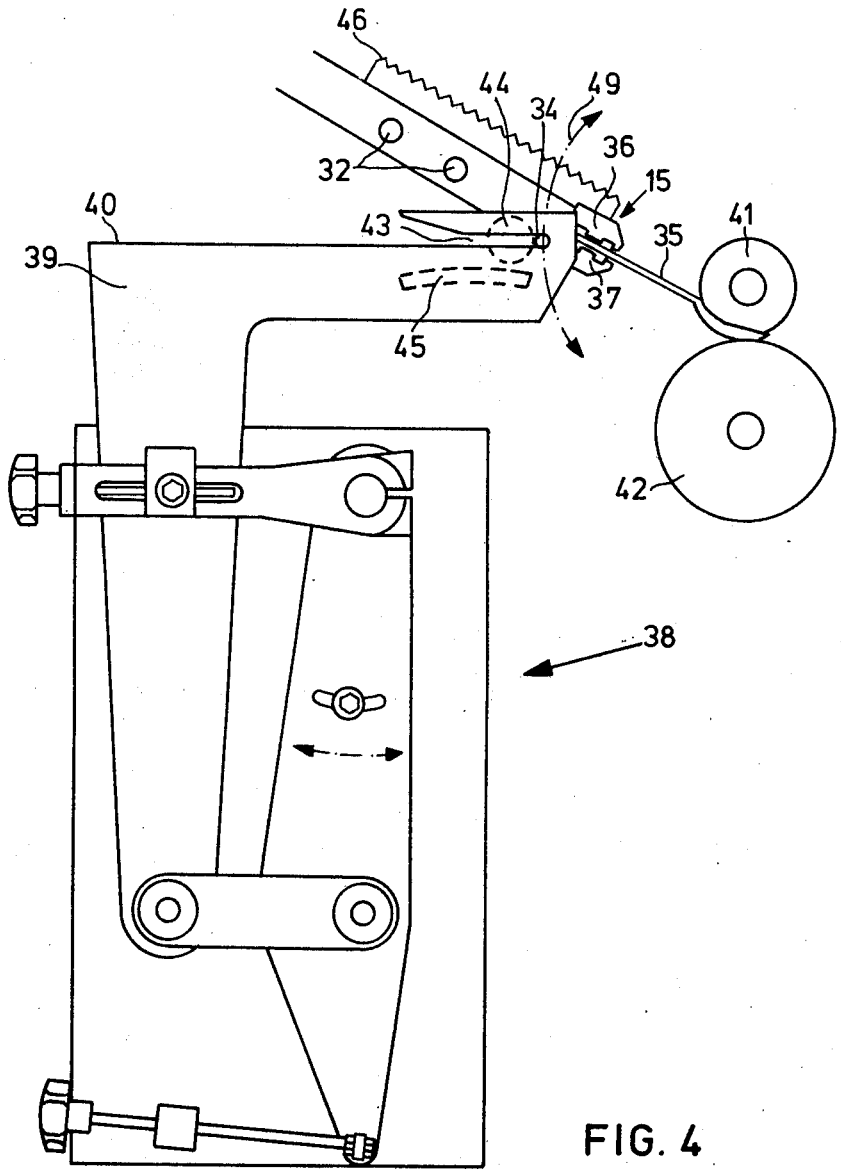
FIG. 4 is a side view of a workpiece holder in front of a polishing machine with a guide device.

After the polishing the pivoting arms 14 are swung up again and thus at the same time retracted, and then the rotatable part 17 of the rotatable turret 1 is advanced one angular step. This process is repeated until all the polishing machines have been passed through. During the polishing operation in the machine 7, 8 the guide arms 39 of the guide device 38 shown in FIG. 4 travel in the manner known from the prior art, so that the pivot pins 34 move on an arc 49 of a circle. In the other polishing machines guide arms provided with guide surfaces 40 and slots 43 to receive the pivot pins 34 are likewise provided, but in accordance with the necessary movements of the piece of cutlery during the polishing operation these guide arms either stand still or are only movable horizontally. In order to permit such movements of the workpiece holders during the polishing operation, the pneumatic operating cylinders 26 are without pressure in the extended position of the pivoting arms 14. After all the polishing machines have been passed through, the workpiece holder described arrives once again at the re-clamping device 9. In this re-clamping device 9 the pieces of cutlery are gripped by a workpiece holder 15 of the turret 2 by their portions which were polished in the first work cycle. The same work cycle is then effected as on the turret 1, the pieces of cutlery 35 being thereby pre-polished and finish-polished on their handles and then released in the unclamping device.

While this device has been described with particular reference to its use with polishing machines having six work stations, it should not be construed to be so limited and may be utilized in polishing machines having many different numbers of work stations. It will be obvious to those skilled in the art that various changes may be made without departing from the scope of the invention and that the invention is not to be considered limited to what is shown in the drawings and described in the specification.

What is claimed is:

1. An installation for polishing pieces of cutlery in a circular path through a plurality of work stations comprising:

first and second rotatable conveyors, each of said conveyors capable of moving through a circular path for the transportation of pieces of cutlery, each of said conveyors including a rotatable turret capable of being driven intermittently about a vertical axis of rotation;

a plurality of equi-angularly spaced pivoting arms connected to each of said rotatable turrets, each of said pivoting arms including an inner arm section having one end articulated about a horizontal axis of said rotatable turret and capable of being driven radially outwardly about said horizontal axis, and an outer arm section articulated to the other end of said inner arm section and extending radially outwardly of said inner arm;

a workpiece holder connected to the free end of each of said outer arm sections;

swivelling means movble between a first position and a second position, said swivelling means being coupled to said inner and said outer arms for swivelling said arms and associated said holders and for holding said inner arm section in a substantially vertical position and for holding said outer arm section in a substantially horizontal position when said swivelling means is in said first position and for holding said inner and said outer arm sections in a radially extended position when said swivelling means is in said second position; and a stop means between said inner arm section and said outer arm section for maintaining a minimum angle between said inner arm section and said outer arm section.

2. An installation according to claim 1 further including a hydraulic or pneumatic operating cylinder connecting said pivoting arms to said rotatable turret.

3. An installation according to claim 1, wherein all of said pivoting arms of one of said turrets are driven by a common hydraulic or pneumatic operating cylinder.

4. An installation according to claim 1, wherein the minimum angle is between 80° to 90°.

5. An installation according to claim 1 wherein each of said workpiece holders is mounted for sliding on the outer arm part of its associated arm parallel to the horizontal axis.

6. An installation according to claim 5 further comprising swivelling means between said workpiece holders and said outer arm sections for allowing said workpiece holders to swivel.

7. An installation according to claim 1 wherein each workpiece holder has at least one guide roller with which is associated a cam element on each said work station.

8. An installation according to claim 7, wherein a restoring device counteracting the pivoting by said cam element and guide roller acts on the workpiece holder is provided.

* * * * *